US005334119A

United States Patent [19]

Eloranta

[11] Patent Number: 5,334,119

[45] Date of Patent: Aug. 2, 1994

[54] HURDLE BOOM HOLDER

[76] Inventor: Erkki M. Eloranta, GranöS-73197 Köping, Sweden

[21] Appl. No.: 917,136

[22] PCT Filed: Feb. 7, 1991

[86] PCT No.: PCT/FI91/00041

§ 371 Date: Aug. 10, 1992

§ 102(e) Date: Aug. 10, 1992

[87] PCT Pub. No.: WO91/12060

PCT Pub. Date: Aug. 22, 1991

[30] Foreign Application Priority Data

Feb. 8, 1990 [FI] Finland ..... 900637

[51] Int. Cl.[5] ..... A63B 65/22

[52] U.S. Cl. ..... 482/16; 482/38

[58] Field of Search ..... 403/234, 196, 195, 383; 285/311, 308; 482/14, 15, 16, 17, 34–38, 41; 182/179; 248/230

[56] References Cited

U.S. PATENT DOCUMENTS

| | | | |
|---|---|---|---|
| 932,142 | 8/1909 | Kimmel | 482/17 |
| 3,105,682 | 10/1963 | Ahrens | 482/17 |
| 3,347,572 | 10/1967 | Pfaff, Jr. et al. | 248/230 |
| 3,356,395 | 12/1967 | Dygert et al. | 482/38 |
| 3,752,472 | 8/1973 | Snead | 482/35 |
| 3,850,401 | 11/1974 | Snediker | 248/230 |
| 4,946,139 | 8/1990 | Tomellini . | |
| 4,953,819 | 9/1990 | Davis | 248/230 |
| 5,096,187 | 3/1992 | Marples | 482/41 |

FOREIGN PATENT DOCUMENTS

| | | | |
|---|---|---|---|
| 2311697 | 9/1974 | Fed. Rep. of Germany . | |
| 627373 | 6/1927 | France | 248/230 |
| 1378865 | 3/1988 | U.S.S.R. | 482/17 |

*Primary Examiner*—Richard J. Apley
*Assistant Examiner*—Jerome Donnelly
*Attorney, Agent, or Firm*—Larson and Taylor

[57] ABSTRACT

A cupholder for supporting a hurdle boom (10) includes a gliding part (1) which is sleeve-like and mounted around a pillar so as to be moved vertically on the pillar and a support (2) on which the end of the boom (1) is supported. The sleeve-like gliding part is broken at one point and a locking apparatus for the gliding part if formed by a tightening apparatus which pulls the opposite edges of the gliding part towards each other so that the gliding part presses against the pillar.

8 Claims, 2 Drawing Sheets

Fig.5
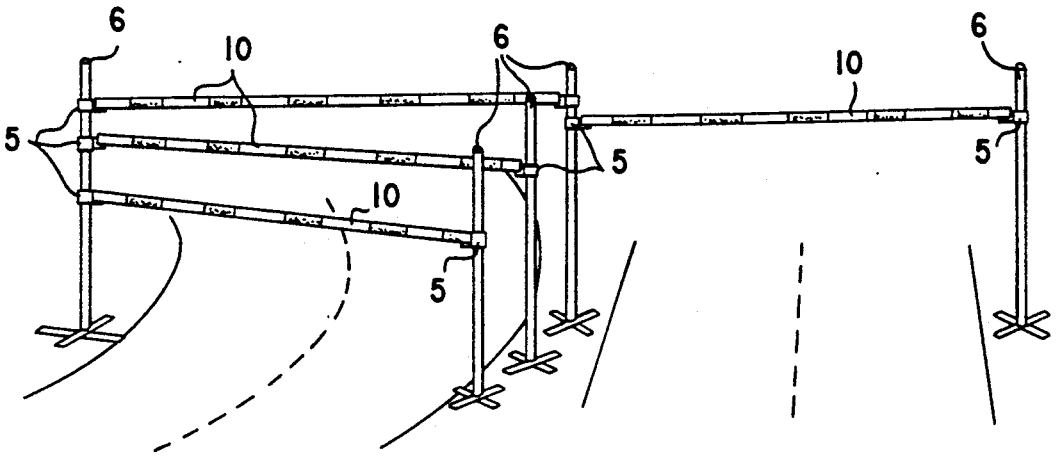
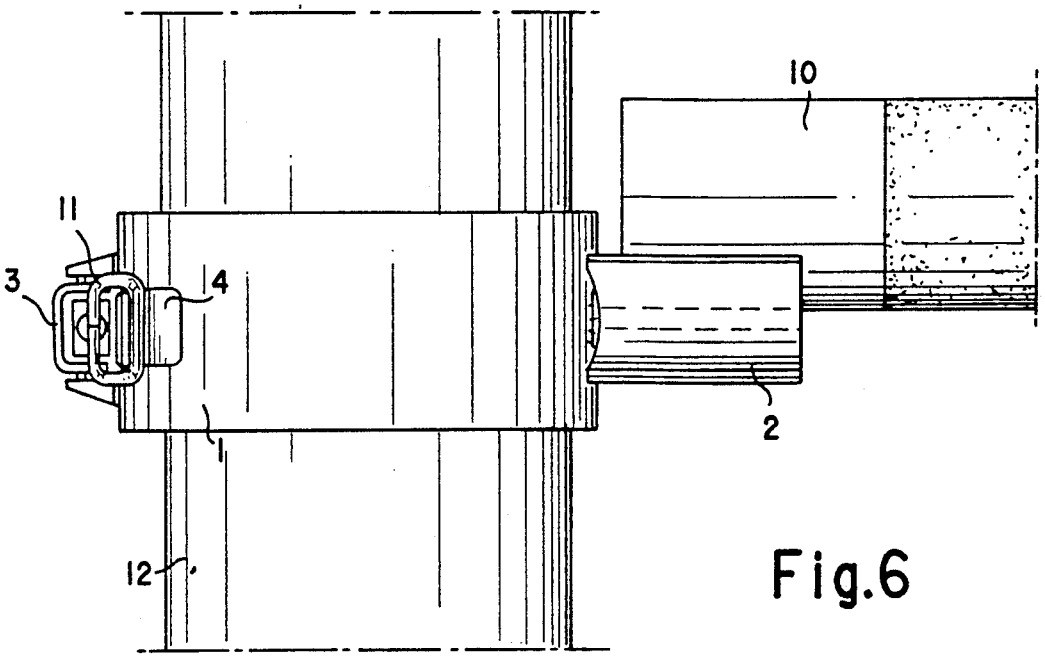
Fig.6

HURDLE BOOM HOLDER

FIELD OF THE INVENTION

The invention relates to a holding apparatus or cupholder for a hurdle boom. The boom is supported by the cupholder to a desired height by tightening of the cupholder on a vertical pillar.

BACKGROUND OF THE INVENTION

A known boom support is presented in German publication nr 2 311 697. That support can be moved in the vertical direction and turned on a pillar which has a round cross-section. This boom support is locked on the pillar by tightening a brake wedge against the surface of the pillar. The wedge stands out from a sleeve-like gliding part. The holder or support consists of an extension, on which the boom is situated.

The above-mentioned boom holder has various shortcomings. For example, it is impossible to get the same pressing or locking force repeatedly after one or several openings. Also, it is desired for a boom support to give in during training or use when pressed down with a certain force. With the mentioned boom holder, there is no control for the locking force of the tightening apparatus, and it is also impossible to tighten the holder over and over again with the same locking force. In addition, the gliding part of the holder is so wide on the pillar that it can turn crosswise a little when the holder is locked on the pillar. This causes the locking forces to vary uncontrollably because the gliding part or the pressing wedge can press even depressions in the pillar surface with their sharp edges.

With the cupholder according to the present invention, these shortcomings are avoided.

SUMMARY OF THE INVENTION

The most important advantages of the invention are that the locking or tightening force of the boom holder can be set beforehand and the holder has the same tightening force after several openings. Also, the turning of the holder around the pillar can be prevented by using polygonal pillars and correspondingly shaped polygonal gliding parts of the holders. As the holder should stay in place during a race and also when the boom is falling down, the polygonal pillar is also advantageous in preventing any turning of the holder in these circumstances. Of course, during training, round pillars are safe because the holders can give in downwards and turn around the pillar. With the present invention, moving and turning of the holder on the pillar can additionally be made easier by adjusting the locking apparatus so that the diameter of the sleeve-like gliding part is opened to a greater degree.

BRIEF DESCRIPTION OF THE DRAWINGS

In the following, the invention is described in detail with references to the attached drawings.

FIG. 5 is an elevational perspective view of combined hurdle.

FIG. 6 is an end elevation view of a boom supported by a cupholder according to the invention.

DETAILED DESCRIPTION OF THE PREFERRED EMBODIMENTS

Figure 1:
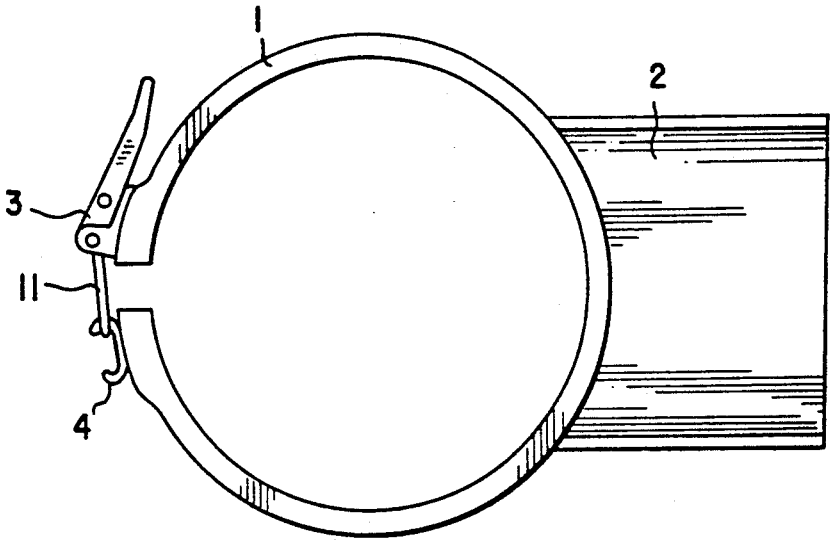
FIG. 1 is a top plan view of a cupholder according to the present invention.

In FIG. 1, there is shown a boom holder or cupholder which has a round gliding part 1. A cupped support 2 is fixed to and extends from the gliding part 1. It will be appreciated that gliding part 1 is like a broken or split sleeve in that it can bend and tighten around a round pillar. To one of the free ends of the break points of the gliding part 1 there is fastened a tightening apparatus 3 while to the other free end there is fastened an opposite part 4 which together comprise a tightening means. The opposite part 4 has bendings 8 at both ends so that loop 11 of the tightening apparatus 3 can both pull when tightening and push when opening the gliding part 1. The loop 11 consists of a threaded extension engaging the apparatus 3 which threaded extension has a corresponding nut. The length of the extension can thus be adjusted by turning the loop, so that the inward or radial pressing force of the gliding part 1 against the pillar can be adjusted.

Figure 2:
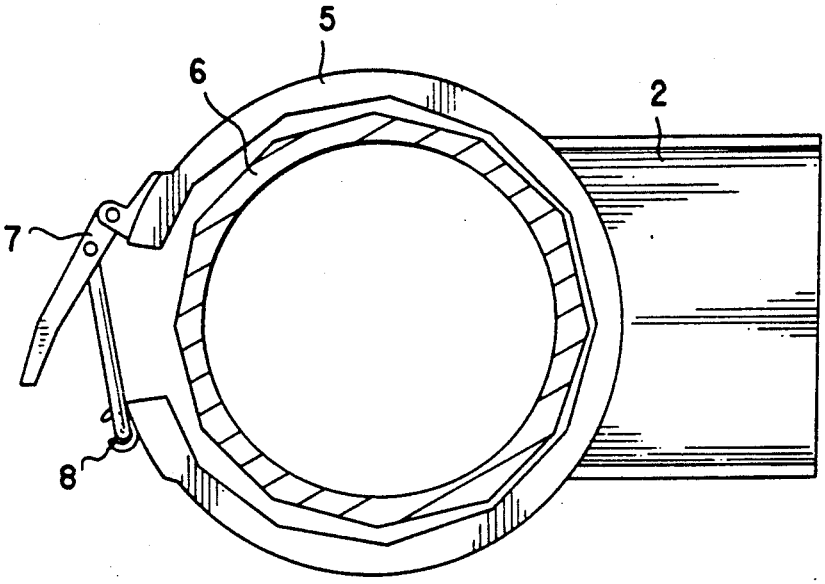
FIG. 2 is a top plan view of the cupholder of FIG. 1 in an opened position.

In FIG. 2, there is depicted a 12-sided pillar 6 which is part of a boom support arrangement. The gliding part 5 provided around a pillar 6 is correspondingly 12-angled. The opposite part 8 for the tightening apparatus 7 is made short so that a relatively greater opening can be achieved when loop 11 pushes thereagainst to allow the polygon gliding part 5 to be turned around on the pillar 6.

Figure 3:
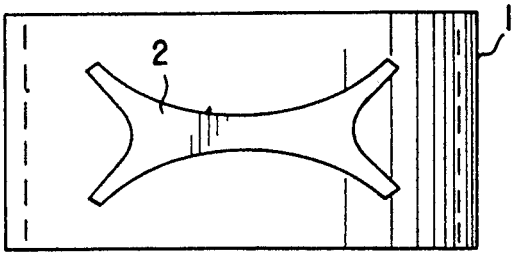
FIG. 3 is a front elevation view of the cupholder of FIG. 1.
Figure 4:
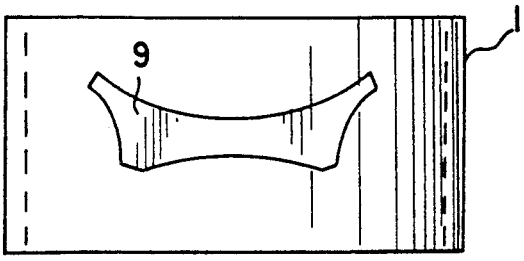
FIG. 4 is a front elevation view of another embodiment of a cupholder according to the present invention.

In FIGS. 3 and 4, there are shown end views of cup-like supports 2, 9, respectively. The supports are reversible so that the two cup shapes of each support (and the two different supports) have different depths in order to provide for adjusting the stability of the boom resting therein.

In FIG. 5, there has been depicted a combined hurdle using several pillars 6 and booms 10 and cupholders according to the invention. The pillars 6 have several cupholders forming a fan-like hurdle and a usual hurdle. The directions and the heights of the booms can be chosen in a stepless manner using round pillars, while the directions of the booms can be chosen from the available angles when using polygon pillars.

In FIG. 6, there is presented a round pillar 12 and a gliding part 1 tightened around pillar 12. A support 2 supports the boom 10. The gliding part 1 has been tightened by locking apparatus 3 as presented in FIG. 1. The cupholder is tightened to a certain tightness which is able to give in downwards if a horse falls on the boom. The tightening mechanism is maintained at the adjusted pressing force until the loop 11 is released. Thus the cupholder can be mounted easily in the same position and tightness repeatedly. The cupholder is held by friction repeatedly in the same condition against downwards pressing forces, especially if one or both of the parts (holder or pillar) is made of plastic.

When using polygon pillars, no turning of the holder is permitted but only an easy giving in downwards if the holder is in training tightness. The remountings of the booms, particularly, with the fan-like hurdles, are easy because the polygon pillar determines the directions of the booms based on numbers of the angles of the pillar.

The invention, however, is in no way restricted to the above example. Modifications can be made within the limits of the invented idea as will be appreciated by those of ordinary skill in the art.

I claim:

1. An apparatus for holding an end of a hurdle boom at a desired height and horizontal orientation comprising:

an upright pillar;

a gliding part in he form of a sleeve longitudinally split at one point only and mounted around said pillar, said gliding part having opposed free ends at the split point which are circumferentially spaced from one another in a rest position whereby said gliding part with said free ends in the rest position is freely movable vertically on said pillar;

a support attached to said gliding part at a position laterally opposite the split point and extending horizontally therefrom, said support including an upwardly facing horizontal surface which is concave in shape, such that the end of the boom rests vertically on said horizontal surface of said support; and a tightening means which bridges said free ends of said gliding part for moving said free ends from the rest position to a precise restrained position where said free ends are circumferentially closed toward one another relative to the rest position and said gliding part is radially drawn into frictional engagement with said pillar to hold said gliding part vertically in place, whereby after moving said gliding part to a desired height and horizontal orientation while said free ends are circumferentially spaced from one another said tightening means then moves said free ends to the closed position to hold said support on said gliding part at the desired height and horizontal orientation.

2. An apparatus for holding ah end of a hurdle boom as claimed in claim 1 wherein said tightening means includes an adjusting means for precisely adjusting a space between said free ends when said free ends are in the restrained position whereby the frictional engagement of said gliding part with said pillar is adjustable to a desired amount and the desired amount of frictional engagement is repeatedly attained each time said tightening means is actuated without adjusting said adjusting means.

3. An apparatus for holding an end of a hurdle boom as claimed in claim 1 wherein said tightening means further includes an opening means for moving said free ends from the rest position to an open position where said free ends are circumferentially spaced from one another more than in the rest position whereby said gliding part is more completely radially moved away from frictional engagement with said pillar and hence is more freely movable vertically on said pillar to the desired height and horizontal orientation.

4. An apparatus for holding an end of a hurdle boom as claimed in claim 1 wherein said pillar has a polygonal horizontal cross section; and wherein said gliding part includes an inner periphery which is correspondingly polygonal shaped in horizontal cross section.

5. An apparatus for holding an end of a hurdle boom as claimed in claim 2 wherein said tightening means further includes an opening means for moving said free ends from the rest position to an open position where said free ends are circumferentially spaced from one another more than in the rest position whereby said gliding part is more completely radially moved away from frictional engagement with said pillar and hence is more freely movable vertically on said pillar to the desired height and horizontal orientation.

6. An apparatus for holding an end of a hurdle boom as claimed in claim 2 wherein said pillar has a polygonal horizontal cross section; and wherein said gliding part includes an inner periphery which is correspondingly polygonal shaped in horizontal cross section.

7. An apparatus for holding an end of a hurdle boom as claimed in claim 3 wherein said pillar has a polygonal horizontal cross section; and wherein said gliding part includes an inner periphery which is correspondingly polygonal shaped in horizontal cross section.

8. An apparatus for holding an end of a hurdle boom as claimed in claim 1 wherein said gliding part is reversible on said pillar; and wherein said support includes a second horizontal surface on an opposite side from said first mentioned horizontal surface, said second horizontal surface also being concave shaped such that the one of said horizontal surface which is uppermost receives and holds the end of the boom thereon.

* * * * *